US009942651B2

(12) United States Patent
Chamness et al.

(10) Patent No.: US 9,942,651 B2
(45) **Date of Patent: *Apr. 10, 2018**

(54) MANIPULATION OF PLAYBACK DEVICE RESPONSE USING AN ACOUSTIC FILTER

(71) Applicant: Sonos, Inc., Santa Barbara, CA (US)

(72) Inventors: Mike Chamness, Gloucester, MA (US); Aurelio Ramos, Jamaica Plain, MA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/651,920

(22) Filed: Jul. 17, 2017

(65) Prior Publication Data

US 2017/0318384 A1 Nov. 2, 2017

Related U.S. Application Data

(63) Continuation of application No. 14/831,903, filed on Aug. 21, 2015, now Pat. No. 9,712,912.

(51) Int. Cl.

| | |
|---|---|
| ***H04R 1/00*** | (2006.01) |
| ***H04R 1/28*** | (2006.01) |
| ***H04R 1/34*** | (2006.01) |

(52) U.S. Cl.

CPC ..... *H04R 1/2842* (2013.01); *H04R 1/345* (2013.01); *H04R 2227/005* (2013.01)

(58) Field of Classification Search

CPC ..... H04R 1/2842

See application file for complete search history.

(56) References Cited

U.S. PATENT DOCUMENTS

| | | | |
|---|---|---|---|
| 2,990,907 | A | 7/1961 | Everett |
| 4,799,264 | A | 1/1989 | Plummer |

(Continued)

FOREIGN PATENT DOCUMENTS

| | | | |
|---|---|---|---|
| EP | 0862351 | A2 | 9/1998 |
| EP | 1133896 | B1 | 8/2002 |

(Continued)

OTHER PUBLICATIONS

AudioTron Quick Start Guide, Version 1.0, Mar. 2001, 24 pages.

(Continued)

*Primary Examiner* — Muhammad N Edun

(74) *Attorney, Agent, or Firm* — McDonnell Boehnen Hulbert & Berghoff LLP

(57) ABSTRACT

An acoustic filter includes holes and is configured to receive sound waves generated by an audio driver of a playback device. The sound waves comprise sound waves of a first frequency that radiate according to a first radiation pattern and sound waves of a second frequency that radiate according to a second radiation pattern that is less directed along an axis of the audio driver than the first radiation pattern. The second frequency is lower than the first frequency. The acoustic filter is configured to attenuate the sound waves of the first frequency so that the attenuated sound waves of the first frequency are emitted from the acoustic filter according to an effective radiation pattern that is less directed along the axis of the audio driver than the first radiation pattern and pass the sound waves of the second frequency in substantial accordance with the second radiation pattern.

20 Claims, 11 Drawing Sheets

(56) References Cited

U.S. PATENT DOCUMENTS

| | | | |
|---|---|---|---|
| 4,995,778 | A | 2/1991 | Bruessel |
| 5,440,644 | A | 8/1995 | Farinelli et al. |
| 5,761,320 | A | 6/1998 | Farinelli et al. |
| 5,910,991 | A | 6/1999 | Farrar |
| 5,923,902 | A | 7/1999 | Inagaki |
| 6,032,202 | A | 2/2000 | Lea et al. |
| 6,256,554 | B1 | 7/2001 | Dilorenzo |
| 6,404,811 | B1 | 6/2002 | Cvetko et al. |
| 6,469,633 | B1 | 10/2002 | Wachter |
| 6,522,886 | B1 | 2/2003 | Youngs et al. |
| 6,611,537 | B1 | 8/2003 | Edens et al. |
| 6,631,410 | B1 | 10/2003 | Kowalski et al. |
| 6,757,517 | B2 | 6/2004 | Chang |
| 6,778,869 | B2 | 8/2004 | Champion |
| 7,072,477 | B1 | 7/2006 | Kincaid |
| 7,130,608 | B2 | 10/2006 | Hollstrom et al. |
| 7,130,616 | B2 | 10/2006 | Janik |
| 7,143,939 | B2 | 12/2006 | Henzerling |
| 7,236,773 | B2 | 6/2007 | Thomas |
| 7,295,548 | B2 | 11/2007 | Blank et al. |
| 7,391,791 | B2 | 6/2008 | Balassanian |
| 7,483,538 | B2 | 1/2009 | McCarty et al. |
| 7,490,044 | B2 | 2/2009 | Kulkarni |
| 7,519,188 | B2 | 4/2009 | Berardi et al. |
| 7,571,014 | B1 | 8/2009 | Lambourne et al. |
| 7,630,500 | B1 | 12/2009 | Beckman et al. |
| 7,630,501 | B2 | 12/2009 | Blank et al. |
| 7,643,894 | B2 | 1/2010 | Braithwaite |
| 7,657,910 | B1 | 2/2010 | McAulay et al. |
| 7,853,341 | B2 | 12/2010 | McCarty et al. |
| 7,987,294 | B2 | 7/2011 | Bryce et al. |
| 8,014,423 | B2 | 9/2011 | Thaler et al. |
| 8,045,952 | B2 | 10/2011 | Qureshey et al. |
| 8,063,698 | B2 | 11/2011 | Howard |
| 8,103,009 | B2 | 1/2012 | McCarty et al. |
| 8,139,774 | B2 | 3/2012 | Berardi et al. |
| 8,160,281 | B2 | 4/2012 | Kim et al. |
| 8,175,292 | B2 | 5/2012 | Aylward et al. |
| 8,229,125 | B2 | 7/2012 | Short |
| 8,233,632 | B1 | 7/2012 | MacDonald et al. |
| 8,234,395 | B2 | 7/2012 | Millington et al. |
| 8,238,578 | B2 | 8/2012 | Aylward |
| 8,243,961 | B1 | 8/2012 | Morrill |
| 8,265,310 | B2 | 9/2012 | Berardi et al. |
| 8,290,185 | B2 | 10/2012 | Kim |
| 8,306,235 | B2 | 11/2012 | Mahowald |
| 8,325,935 | B2 | 12/2012 | Rutschman |
| 8,331,585 | B2 | 12/2012 | Hagen et al. |
| 8,391,501 | B2 | 3/2013 | Khawand et al. |
| 8,452,020 | B2 | 5/2013 | Gregg et al. |
| 8,483,853 | B1 | 7/2013 | Lambourne |
| 8,577,045 | B2 | 11/2013 | Gibbs |
| 8,600,075 | B2 | 12/2013 | Lim |
| 8,620,006 | B2 | 12/2013 | Berardi et al. |
| 8,855,319 | B2 | 10/2014 | Liu et al. |
| 8,879,761 | B2 | 11/2014 | Johnson et al. |
| 8,914,559 | B2 | 12/2014 | Kalayjian et al. |
| 8,934,647 | B2 | 1/2015 | Joyce et al. |
| 8,934,655 | B2 | 1/2015 | Breen et al. |
| 8,942,252 | B2 | 1/2015 | Balassanian et al. |
| 8,965,546 | B2 | 2/2015 | Visser et al. |
| 8,977,974 | B2 | 3/2015 | Kraut |
| 8,984,442 | B2 | 3/2015 | Pirnack et al. |
| 9,020,153 | B2 | 4/2015 | Britt, Jr. |
| 2001/0005421 | A1 | 6/2001 | Harris |
| 2001/0042107 | A1 | 11/2001 | Palm |
| 2002/0022453 | A1 | 2/2002 | Balog et al. |
| 2002/0026442 | A1 | 2/2002 | Lipscomb et al. |
| 2002/0124097 | A1 | 9/2002 | Isely et al. |
| 2003/0157951 | A1 | 8/2003 | Hasty |
| 2004/0024478 | A1 | 2/2004 | Hans et al. |
| 2004/0131217 | A1* | 7/2004 | Opie ..... H04R 1/26 381/336 |
| 2007/0142944 | A1 | 6/2007 | Goldberg et al. |
| 2009/0310808 | A1 | 12/2009 | Button et al. |
| 2010/0142735 | A1 | 6/2010 | Yoon et al. |
| 2011/0170710 | A1 | 7/2011 | Son |
| 2012/0051558 | A1 | 3/2012 | Kim et al. |
| 2012/0127831 | A1 | 5/2012 | Gicklhorn et al. |
| 2012/0263325 | A1 | 10/2012 | Freeman et al. |
| 2013/0010970 | A1 | 1/2013 | Hegarty et al. |
| 2013/0028443 | A1 | 1/2013 | Pance et al. |
| 2013/0259254 | A1 | 10/2013 | Xiang et al. |
| 2014/0016784 | A1 | 1/2014 | Sen et al. |
| 2014/0016786 | A1 | 1/2014 | Sen |
| 2014/0016802 | A1 | 1/2014 | Sen |
| 2014/0023196 | A1 | 1/2014 | Xiang et al. |
| 2014/0064550 | A1 | 3/2014 | Wiggins |
| 2014/0112481 | A1 | 4/2014 | Li et al. |
| 2014/0219456 | A1 | 8/2014 | Morrell et al. |
| 2014/0226823 | A1 | 8/2014 | Sen et al. |
| 2014/0294200 | A1 | 10/2014 | Baumgarte et al. |
| 2014/0355768 | A1 | 12/2014 | Sen et al. |
| 2014/0355794 | A1 | 12/2014 | Morrell et al. |
| 2015/0063610 | A1 | 3/2015 | Mossner |
| 2015/0146886 | A1 | 5/2015 | Baumgarte |
| 2015/0201274 | A1 | 7/2015 | Ellner et al. |
| 2015/0281866 | A1 | 10/2015 | Williams et al. |

FOREIGN PATENT DOCUMENTS

| | | | |
|---|---|---|---|
| EP | 1389853 | A1 | 2/2004 |
| EP | 1825713 | B1 | 10/2012 |
| EP | 2860992 | A1 | 4/2015 |
| WO | 200153994 | | 7/2001 |
| WO | 2003093950 | A2 | 11/2003 |
| WO | 2015024881 | A1 | 2/2015 |

OTHER PUBLICATIONS

AudioTron Reference Manual, Version 3.0, May 2002, 70 pages.

AudioTron Setup Guide, Version 3.0, May 2002, 38 pages.

Bluetooth. "Specification of the Bluetooth System: The ad hoc SCATTERNET for affordable and highly functional wireless connectivity," Core, Version 1.0 A, Jul. 26, 1999, 1068 pages.

Bluetooth. "Specification of the Bluetooth System: Wireless connections made easy," Core, Version 1.0 B, Dec. 1, 1999, 1076 pages.

Dell, Inc. "Dell Digital Audio Receiver: Reference Guide," Jun. 2000, 70 pages.

Dell, Inc. "Start Here," Jun. 2000, 2 pages.

"Denon 2003-2004 Product Catalog," Denon, 2003-2004, 44 pages.

First Action Interview Office Action dated Dec. 23, 2016, issued in connection with U.S. Appl. No. 14/831,903, filed Aug. 21, 2015, 5 pages.

International Searching Authority, International Search Report and Written Opinion dated Dec. 2, 2016, issued in connection with International Application No. PCT/US2016/047420, filed on Aug. 17, 2016, 12 pages.

Jo et al., "Synchronized One-to-many Media Streaming with Adaptive Playout Control," Proceedings of SPIE, 2002, pp. 71-82, vol. 4861.

Jones, Stephen, "Dell Digital Audio Receiver: Digital upgrade for your analog stereo," Analog Stereo, Jun. 24, 2000 http://www.reviewsonline.com/articles/961906864.htm retrieved Jun. 18, 2014, 2 pages.

Louderback, Jim, "Affordable Audio Receiver Furnishes Homes With MP3," TechTV Vault. Jun. 28, 2000 retrieved Jul. 10, 2014, 2 pages.

Non-Final Office Action dated Feb. 6, 2017, issued in connection with U.S. Appl. No. 14/831,903, filed Aug. 21, 2015, 10 pages.

Notice of Allowance dated May 25, 2017, issued in connection with U.S. Appl. No. 14/831,903, filed Aug. 21, 2015, 7 pages.

Palm, Inc., "Handbook for the Palm VII Handheld," May 2000, 311 pages.

Presentations at WinHEC 2000, May 2000, 138 pages.

U.S. Appl. No. 60/490,768, filed Jul. 28, 2003, entitled "Method for synchronizing audio playback between multiple networked devices," 13 pages.

(56) References Cited

OTHER PUBLICATIONS

U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

MANIPULATION OF PLAYBACK DEVICE RESPONSE USING AN ACOUSTIC FILTER

CROSS-REFERENCE TO RELATED APPLICATIONS

This application claims priority under 35 U.S.C. § 120 to, and is a continuation of, U.S. patent application Ser. No. 14/831,903, filed on Aug. 21, 2015, entitled "Manipulation of Playback Device Response Using an Acoustic Filter," which is incorporated herein by reference in its entirety.

FIELD OF THE DISCLOSURE

The disclosure is related to consumer goods and, more particularly, to methods, systems, products, features, services, and other elements directed to media playback or some aspect thereof.

BACKGROUND

Options for accessing and listening to digital audio in an out-loud setting were limited until in 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
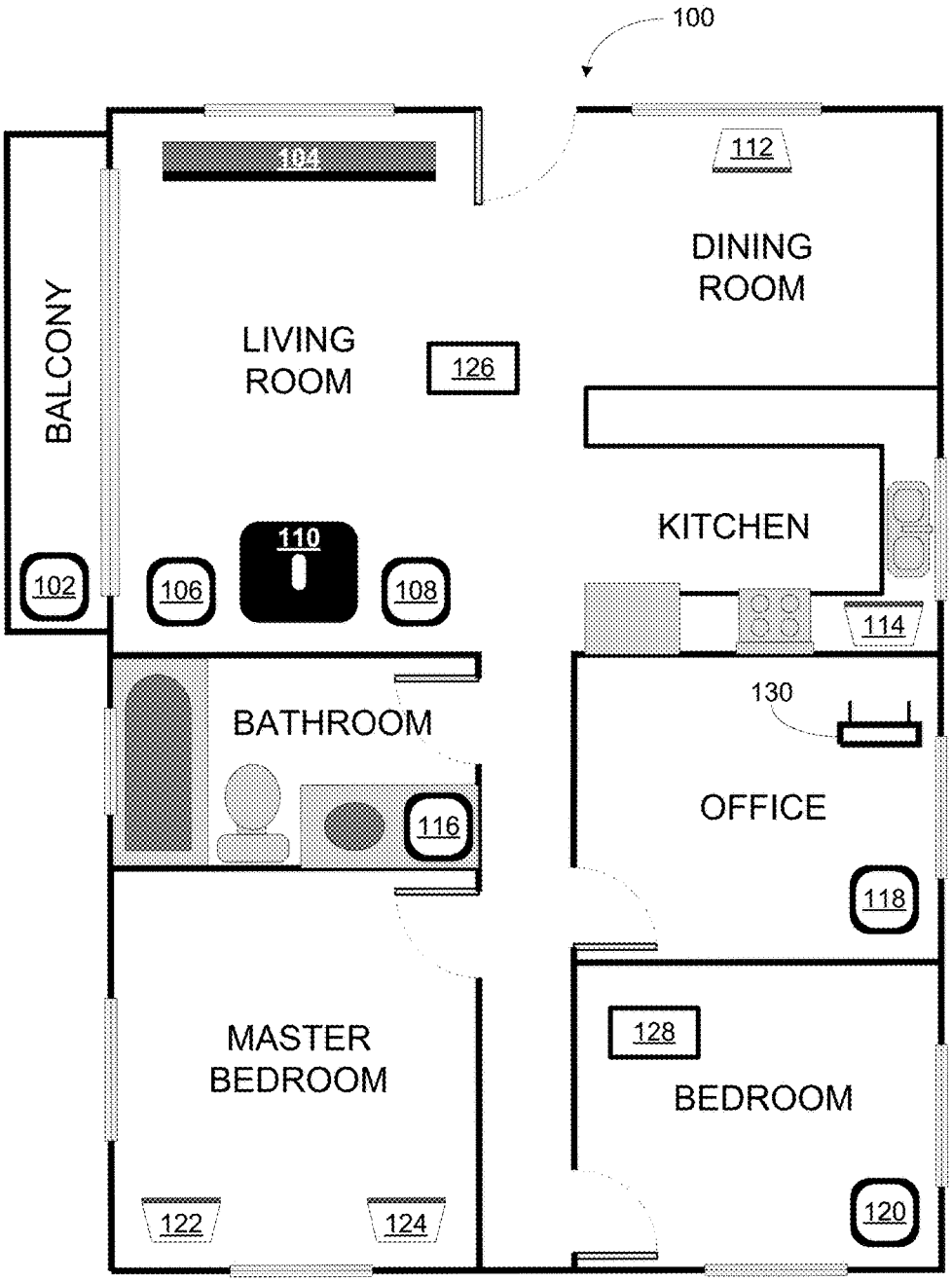
FIG. 1 shows an example media playback system configuration in which certain embodiments may be practiced.

The drawings are for the purpose of illustrating example embodiments, but it is understood that the inventions are not limited to the arrangements and instrumentality shown in the drawings.

DETAILED DESCRIPTION

I. Overview

An audio playback device typically includes at least one audio driver that generates sound waves according to various radiation patterns. Such a radiation pattern may define directionally varying amplitudes of sound waves produced by the corresponding audio driver (i) at a given audio frequency (or range of audio frequencies), (ii) at a given radius from the audio driver, (iii) for a given amplitude of input signal. A radiation pattern corresponding to an audio driver may be dependent on the audio driver's construction, structure, geometry, materials, and/or orientation and position within an enclosure of the playback device, for example. Generally, radiation patterns corresponding to low audio frequencies are more omnidirectional than radiation patterns corresponding to high audio frequencies. For example, a tweeter of a playback device may reproduce high audio frequencies (e.g., 12-16 kHz) according to a first radiation pattern that is defined by (i) a maximum magnitude along an axis of the tweeter and (ii) decreased magnitudes at directions that are off-axis. The tweeter may reproduce low audio frequencies (e.g., 6-10 kHz) according to a second radiation pattern that is defined by a relatively constant magnitude across a range of many directions. (It should be noted that the terms "low frequency" and "high frequency" may be used herein for purposes of describing and/or comparing various ranges of audio frequencies, but such description is not meant to be limiting in any way.)

In some applications, it may be useful to compensate for directional variances between a first radiation pattern corresponding to high frequencies and a second radiation pattern corresponding to low frequencies. For instance, a listener located on the axis of the tweeter may perceive a relative loudness between the low frequencies and high frequencies reproduced by the tweeter as a "true" representation of the source audio content being played by the playback device. However, a listener located off the axis of the tweeter may perceive a distortedly increased loudness of the low frequencies relative to the loudness of the high frequencies when compared to what the listener located on the axis of the tweeter perceives.

To help alleviate this problem, the first radiation pattern of the tweeter corresponding to high frequencies can be "reshaped" by placing an acoustic filter in front of the tweeter. (In other examples, an acoustic filter may be used to reshape a radiation pattern corresponding to an audio driver other than a tweeter.) Such an acoustic filter may include an array of holes configured to receive high frequency sound waves emitted by the tweeter over a given range of directions that includes the axis of the tweeter. The acoustic filter may attenuate the high frequency sound waves emitted over the given range of directions as the high frequency sound waves compress the air within the holes. The acoustic filter may pass low frequency sound waves emitted by the tweeter over the given range of directions without substantially altering the amplitude of the low frequency sound waves. That is, the acoustic filter may pass the low frequency sound waves in substantial accordance with the second radiation pattern. The acoustic filter may be sized so that sound waves (of any frequency) emitted along directions outside the given range of directions will bypass the acoustic filter and not be substantially attenuated by the acoustic filter. This may result in an effective radiation pattern for the high frequencies emitted by the tweeter that, when compared to the first radiation pattern, is less directed along the axis of the tweeter and has a distortedly reduced maximum magnitude along the axis of the tweeter. To further compensate, the playback device may amplify high frequencies reproduced by the tweeter to provide an effective radiation pattern for the high frequencies that resembles the less direction-dependent second radiation pattern of the low frequencies in both magnitude and shape across a relatively large range of directions. These techniques may yield a better listening experience for listeners located at a variety of locations.

Accordingly, some examples described herein include, among other things, an acoustic filter that is configured to be included as a component of a playback device. In operation, the acoustic filter may receive sound waves of a first frequency (or range of frequencies) emitted from an audio driver of the playback device and reshape the radiation pattern of the sound waves of the first frequency to be less directed along an axis of the audio driver. The acoustic filter may also receive sound waves of a second frequency (or range of frequencies) emitted from the audio driver and pass the sound waves of the second frequency without substantial alteration. Other aspects of the examples will be made apparent in the remainder of the description herein.

In one aspect, an acoustic filter includes holes and is configured to receive sound waves generated by an audio driver of a playback device. The sound waves include (i) sound waves of a first frequency that radiate according to a first radiation pattern and (ii) sound waves of a second frequency that radiate according to a second radiation pattern that is less directed along an axis of the audio driver than the first radiation pattern. The second frequency is lower than the first frequency. The acoustic filter is further configured to attenuate the sound waves of the first frequency so that the attenuated sound waves of the first frequency are emitted from the acoustic filter according to an effective radiation pattern that is less directed along the axis of the audio driver than the first radiation pattern. The acoustic filter is further configured to pass the sound waves of the second frequency in substantial accordance with the second radiation pattern.

In another aspect, a playback device includes an audio driver configured to generate (i) sound waves of a first frequency that radiate according to a first radiation pattern and (ii) sound waves of a second frequency that radiate according to a second radiation pattern that is less directed along an axis of the audio driver than the first radiation pattern. The second frequency is lower than the first frequency. The playback device further includes an acoustic filter that includes holes that are configured to receive the sound waves of the first frequency and the sound waves of the second frequency. The holes are further configured to attenuate the sound waves of the first frequency so that the attenuated sound waves of the first frequency are emitted from the acoustic filter according to an effective radiation pattern that is less directed along the axis of the audio driver than the first radiation pattern. The holes are further configured to pass the sound waves of the second frequency in substantial accordance with the second radiation pattern.

It will be understood by one of ordinary skill in the art that this disclosure includes numerous other embodiments. While some examples described herein may refer to functions performed by given actors such as "users" and/or other entities, it should be understood that this is for purposes of explanation only. The claims should not be interpreted to require action by any such example actor unless explicitly required by the language of the claims themselves.

When the terms "substantially" or "about" are used herein, it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

II. Example Operating Environment

FIG. 1 shows an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102, 104, 106, 108, 110, 112, 114, 116, 118, 120, 122, and 124, control devices 126 and 128, and a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
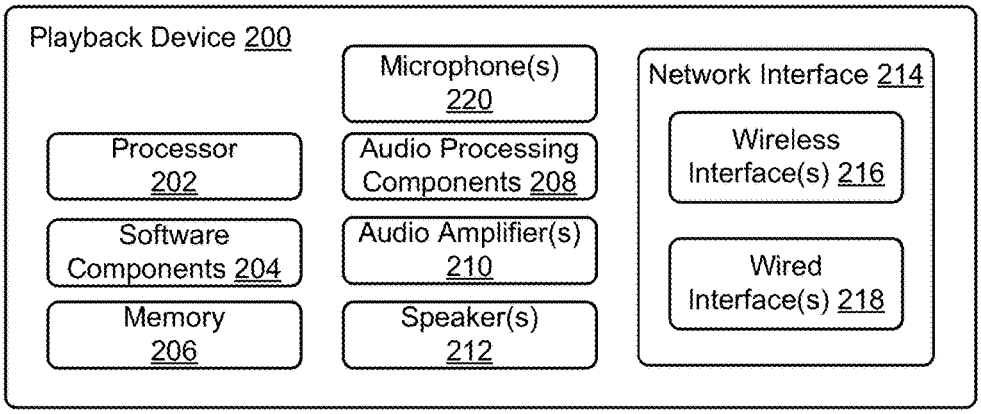
FIG. 2 shows a functional block diagram of an example playback device.

FIG. 2 shows a functional block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, and a network interface 214 including wireless interface(s) 216 and wired interface(s) 218. In one case, the playback device 200 might not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection) or the network interface 214.

The microphone(s) 220 may include an audio sensor configured to convert detected sounds into electrical signals. The electrical signal may be processed by the audio processing components 208 and/or the processor 202. The microphone(s) 220 may be positioned in one or more orientations at one or more locations on the playback device 200. The microphone(s) 220 may be configured to detect sound within one or more frequency ranges. In one case, one or more of the microphone(s) 220 may be configured to detect sound within a frequency range of audio that the playback device 200 is capable or rendering. In another case, one or more of the microphone(s) 220 may be configured to detect sound within a frequency range audible to humans. Other examples are also possible.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being played by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
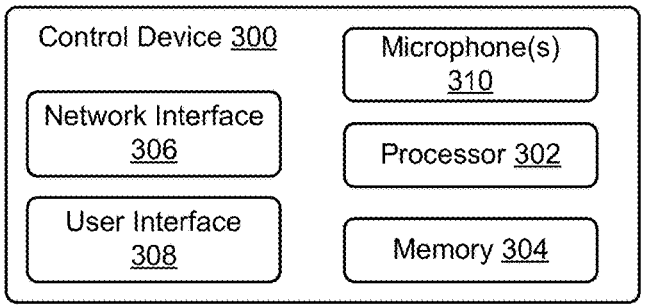
FIG. 3 shows a functional block diagram of an example control device.

FIG. 3 shows a functional block diagram of an example control device 300 that may be configured to be one or both of the control devices 126 and 128 of the media playback system 100. As shown, the control device 300 may include a processor 302, memory 304, a network interface 306, and a user interface 308. In one example, the control device 300 may be a dedicated controller for the media playback system 100. In another example, the control device 300 may be a network device on which media playback system controller application software may be installed, such as for example, an iPhone™ iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be configured to store instructions executable by the processor 302 to perform those functions. The memory 304 may also be configured to store the media playback system controller application software and other data associated with the media playback system 100 and the user.

The microphone(s) 310 may include an audio sensor configured to convert detected sounds into electrical signals. The electrical signal may be processed by the processor 302. In one case, if the control device 300 is a device that may also be used as a means for voice communication or voice recording, one or more of the microphone(s) 310 may be a microphone for facilitating those functions. For instance, the one or more of the microphone(s) 310 may be configured to detect sound within a frequency range that a human is capable of producing and/or a frequency range audible to humans. Other examples are also possible.

In one example, the network interface 306 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

Figure 4:
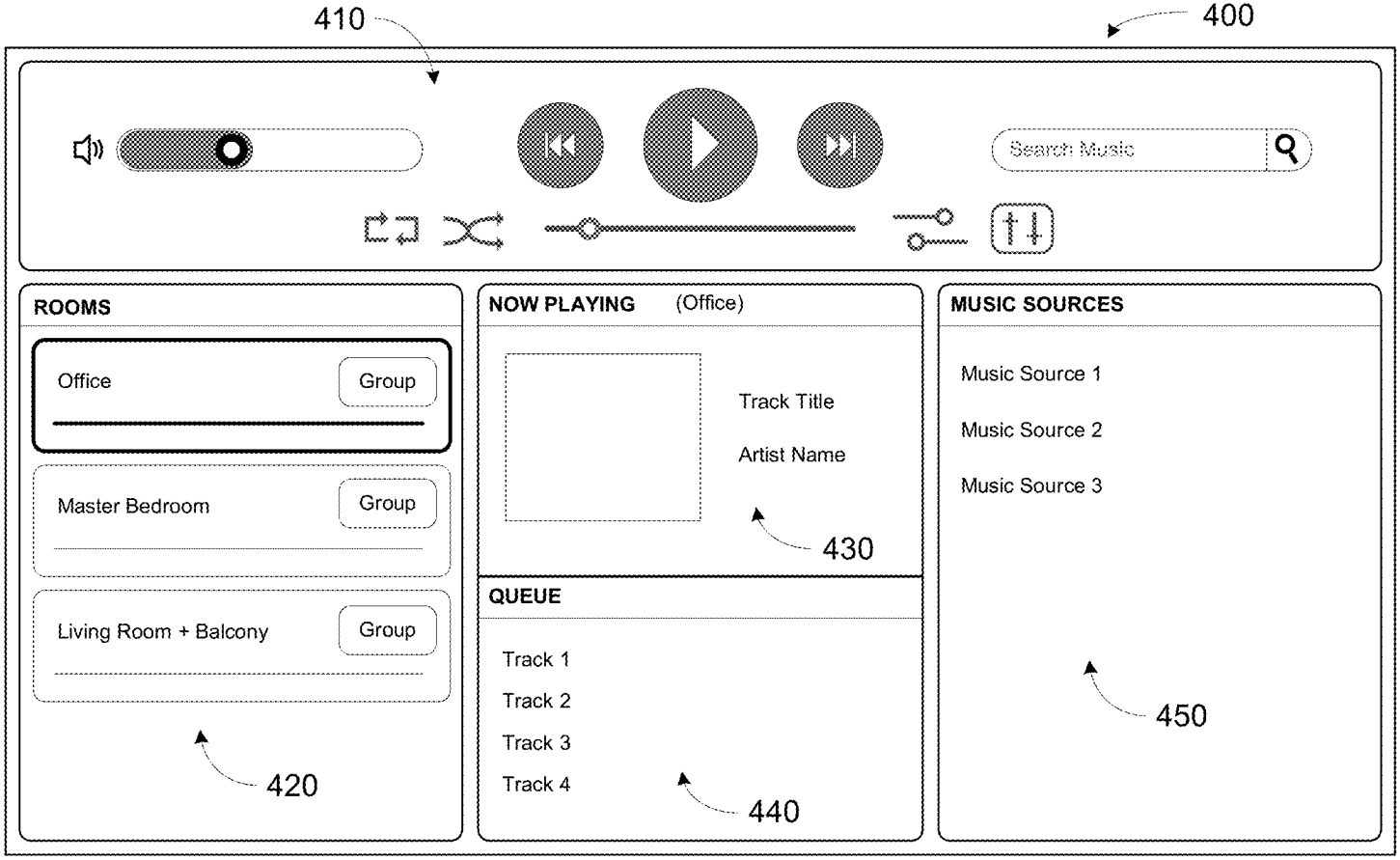
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The user interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the user interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the user interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the user interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g. according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

III. Example Methods and Systems Related to Manipulation of Playback Device Response Using an Acoustic Filter As discussed above, some examples described herein include, among other things, an acoustic filter that is configured to be included as a component of a playback device. In operation, the acoustic filter may receive sound waves of a first frequency (or range of frequencies) emitted from an audio driver of the playback device and reshape the radiation pattern of the sound waves of the first frequency to be less directed along an axis of the audio driver. The acoustic filter may also receive sound waves of a second frequency (or range of frequencies) emitted from the audio driver and pass the sound waves of the second frequency without substantial alteration. Other aspects of the examples will be made apparent in the remainder of the description herein.

Hereinafter, any reference to a "first frequency" may also refer to a first range of frequencies that includes the first frequency, and any reference to a "second frequency" may also refer to a second range of frequencies that includes the second frequency.

Figure 5:
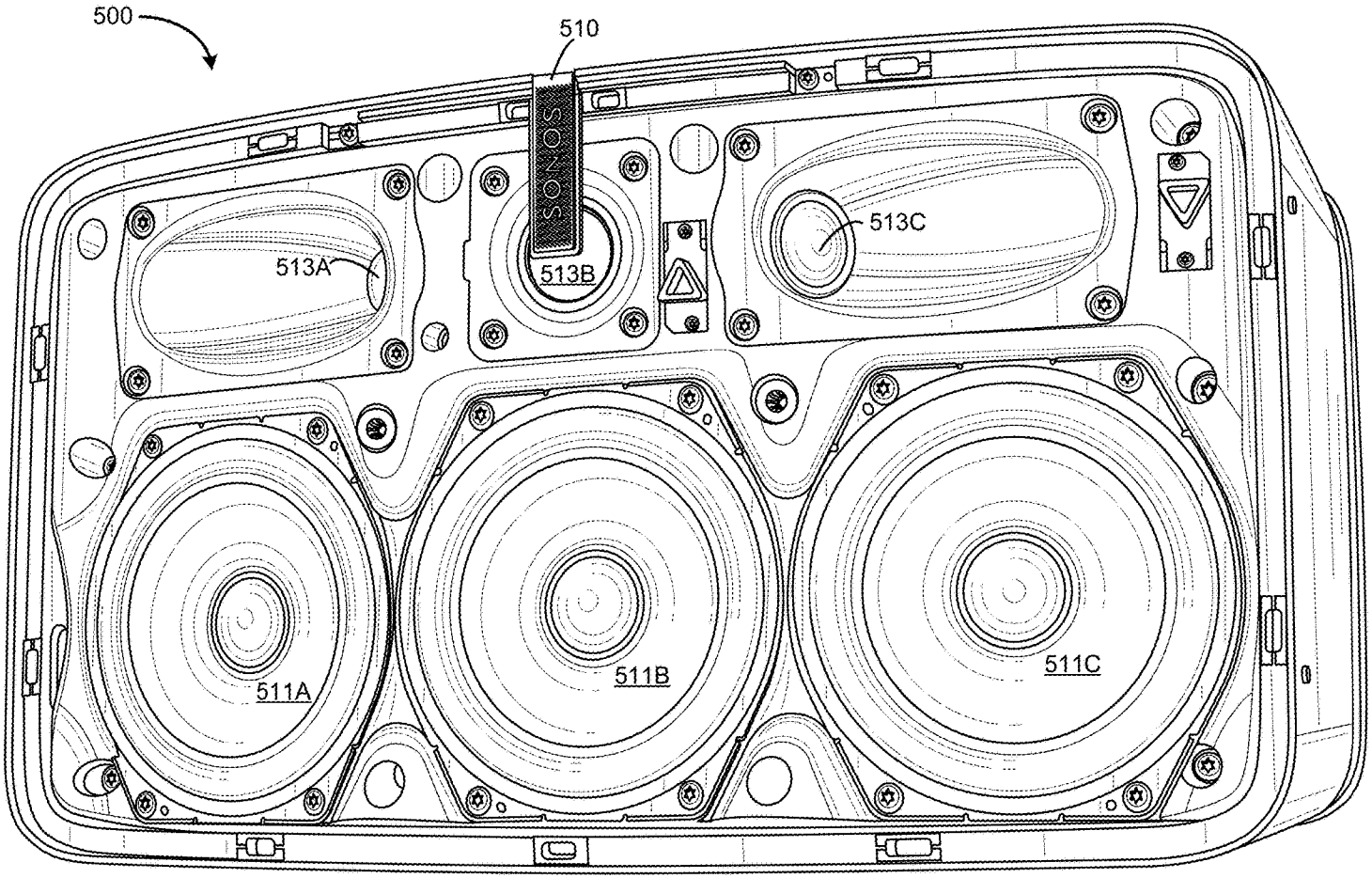
FIG. 5 shows an example playback device with an acoustic filter.

FIG. 5 shows an example playback device 500 including an acoustic filter 510. In some examples, the acoustic filter 510 may resemble acoustic filter 610 depicted in FIG. 6 or acoustic filter 710 depicted in FIGS. 7B, 7C, and 7D. As such, the acoustic filter 510 may be composed of metal, plastic, carbon fiber, or similar materials, have a somewhat rectangular shape, and have one or more holes. The acoustic filter 510 may have a shape other than a rectangle as well. In some instances, the holes of the acoustic filter 510 may be spaced with some degree of random and/or non-random variance.

The playback device 500 may include several audio drivers, namely woofers 511A, 511B, and 511C, and tweeters 513A, 513B, and 513C. The acoustic filter 510 may be positioned in front of the tweeter 513B so that the acoustic filter 510 may receive at least some of the sound waves emitted by the tweeter 513B. As shown in FIG. 5, the acoustic filter 510 may be sized and positioned so that (i) some of the sound waves emitted by the tweeter 513B bypass the acoustic filter 510 and (ii) substantially all of the sound waves emitted by the audio drivers 511A, 511B, 511C, 513A, and 513C bypass the acoustic filter 510.

Additional examples of the acoustic filter 510 are included in U.S. Non-Provisional patent application Ser. No. 14/831,910, filed on Aug. 21, 2015, the entirety of which is incorporated by reference in its entirety.

FIGS. 7A, 7B, 7C, and 7D depict example radiation patterns of an audio driver 702. The radiation patterns depicted in FIGS. 7A-D might not be shown to scale and may differ somewhat in shape from the actual shapes the depicted radiation patterns take during operation of the audio driver 702. In some examples, the audio driver 702 in FIGS. 7A-D represents the tweeter 513B depicted in FIG. 5.

Figure 7A:
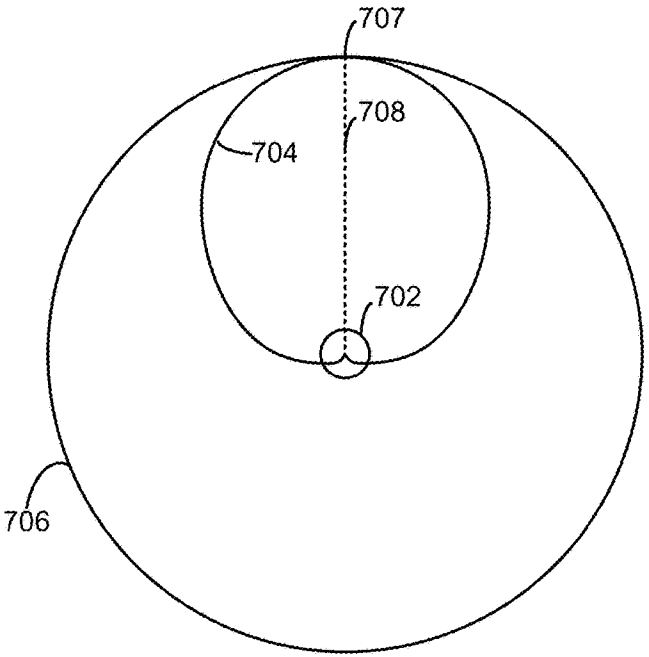
FIG. 7A shows example radiation patterns of an audio driver.

FIG. 7A shows example radiation patterns of the audio driver 702. The audio driver 702 may generate sound waves of a first frequency (e.g., 12-16 kHz) that radiate according to a first radiation pattern 704. The audio driver 702 may also generate sound waves of a second frequency (e.g., 6-10 kHz) that radiate according to a second radiation pattern 706. As shown in FIG. 7A, the first radiation pattern 704 has a maximum magnitude 707 along an axis 708 of the audio driver 702, whereas the second radiation pattern 706 is substantially omnidirectional. In other examples, the second radiation pattern 706 might not be substantially omnidirectional, but may still be less directed along the axis 708 than the first radiation pattern 704. In some examples, the axis 708 may correspond to a center line or axis of symmetry of the audio driver 702 and/or a center line or axis of symmetry of a playback device that includes the audio driver 702, but the axis 708 may take on other forms as well. For example, the axis 708 may represent a rotational axis of symmetry of the tweeter 513B of FIG. 5.

Figure 7B:
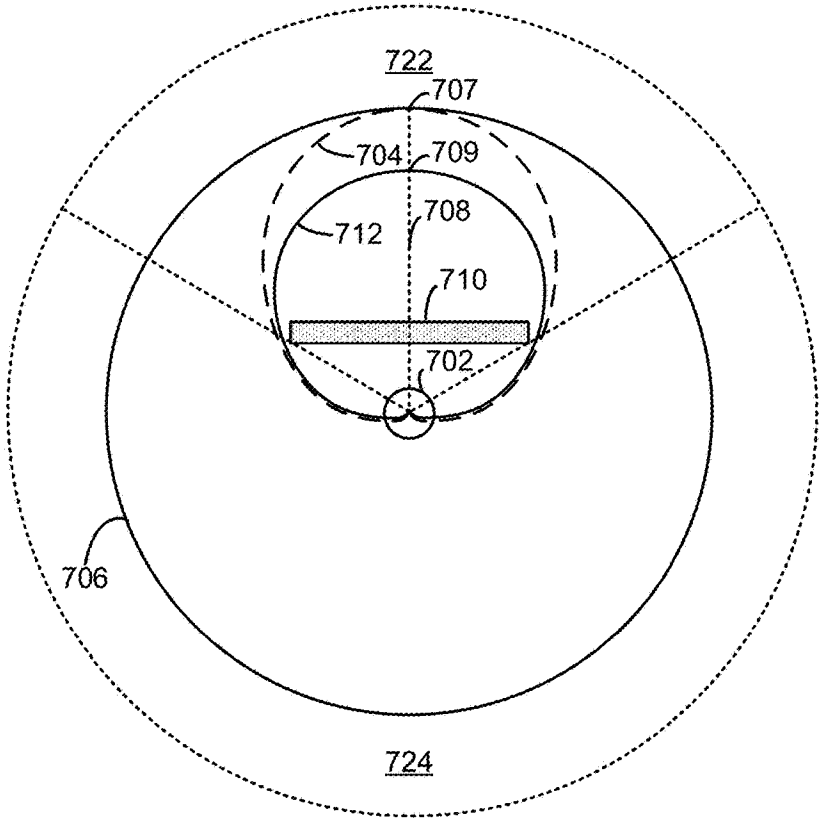
FIG. 7B shows an example acoustic filter and further example radiation patterns of an audio driver.

FIG. 7B shows an example acoustic filter 710 and further example radiation patterns of the audio driver 702. In some examples, the acoustic filter 710 may represent the acoustic filter 510 of FIG. 5. The acoustic filter 710 may include holes that are configured to attenuate sound waves of the first frequency. In some instances, the acoustic filter 710 is placed in front of the audio driver 702 to produce an effective radiation pattern 712 for sound waves of the first frequency that are emitted by the audio driver 702.

In operation, the acoustic filter 710 receives a first set of sound waves generated by the audio driver 702. The first set of sound waves oscillate at the first frequency and propagate within the first range of directions 722. The first range of directions 722 (i) may correspond to directions from which the acoustic filter 710 is positioned to receive sound waves propagating from the audio driver 702 and (ii) may include the axis 708. The first set of sound waves may be attenuated by the acoustic filter 710, resulting in the effective radiation pattern 712 that is less directed along the axis 708 than the first radiation pattern 704. For example, the effective radiation pattern 712 may have a maximum magnitude 709 along the axis 708 like the maximum magnitude 707 of the first radiation pattern 704. However, the maximum magnitude 709 of the effective radiation pattern 712 may be less than the maximum magnitude 707 of the first radiation pattern 704.

The audio driver 702 also generates a second set of sound waves of the first frequency that propagate within the second range of directions 724. The second range of directions 724 may correspond to directions from which the acoustic filter 710 is not positioned to receive sound waves propagating from the audio driver 702 and might not include the axis 708. As such, the second set of sound waves propagating within the second range of directions 724 may bypass the acoustic filter 710 without being substantially attenuated by the holes of the acoustic filter 710. As a result, the first radiation pattern 704 and the effective radiation pattern 712 may be substantially equal throughout the second range of directions 724.

Sound waves of the second frequency generated by the audio driver 702, whether propagating within the first range of directions 722 or the second range of directions 724, might not be substantially attenuated by the acoustic filter 710. That is, sound waves of the second frequency propagating within the first range of directions 722 may pass through the holes of the acoustic filter without being substantially attenuated and sound waves of the second frequency propagating within the second range of directions 724 might not interact with the acoustic filter 710 at all.

Figure 7C:
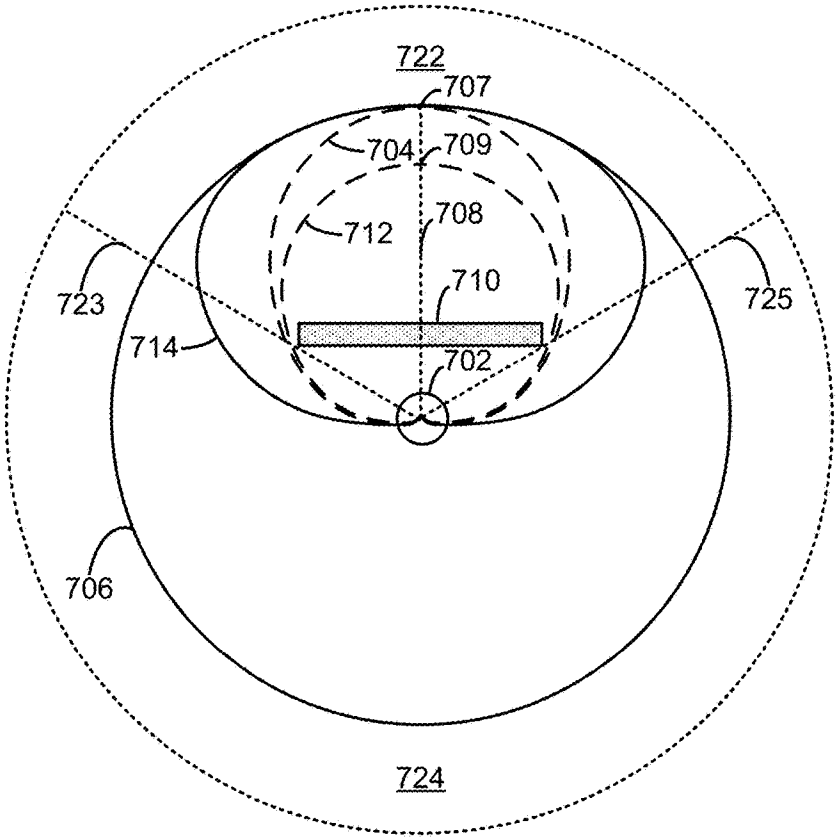
FIG. 7C shows an example acoustic filter and yet further example radiation patterns of an audio driver.

FIG. 7C shows yet further example radiation patterns of the audio driver 702. In some instances, it may be useful to further manipulate the effective radiation pattern 712 so that listeners at a variety of locations may perceive a loudness of the first frequency relative to the second frequency that closely resembles the source audio content. The playback device that includes the audio driver 702 may provide a signal to the audio driver 702 so that the audio driver 702 generates sound waves according to the amplitudes and respective audio frequencies represented by the signal. The playback device may amplify a portion of the signal that corresponds to the sound waves of the first frequency to compensate for the attenuation of the sound waves of the first frequency that the acoustic filter 710 provides.

For example, the effective radiation pattern 712 has a reduced maximum magnitude 709 when compared to the maximum magnitude 707 of the second radiation pattern 706. (The first radiation pattern 704 and the second radiation pattern 706 may share a maximum magnitude 707.) By amplifying the portion of the signal that corresponds to the first frequency, an effective radiation pattern 714 may be formed. In a sense, this occurs by "expansion" of the effective radiation pattern 712.

The effective radiation pattern 714 may be substantially equal in magnitude to the second radiation pattern 706 over the first range of directions 722. In FIG. 7C, the effective radiation pattern 714 is shown as being about equal in magnitude to the second radiation pattern 706 over most of the first range of directions 722. Near the boundaries 723 and 725 that separate the first range of directions 722 from the second range of directions 724, a difference in magnitude between the effective radiation pattern 714 and the second radiation pattern 706 becomes more pronounced, but may still be considered non-substantial.

Figure 7D:
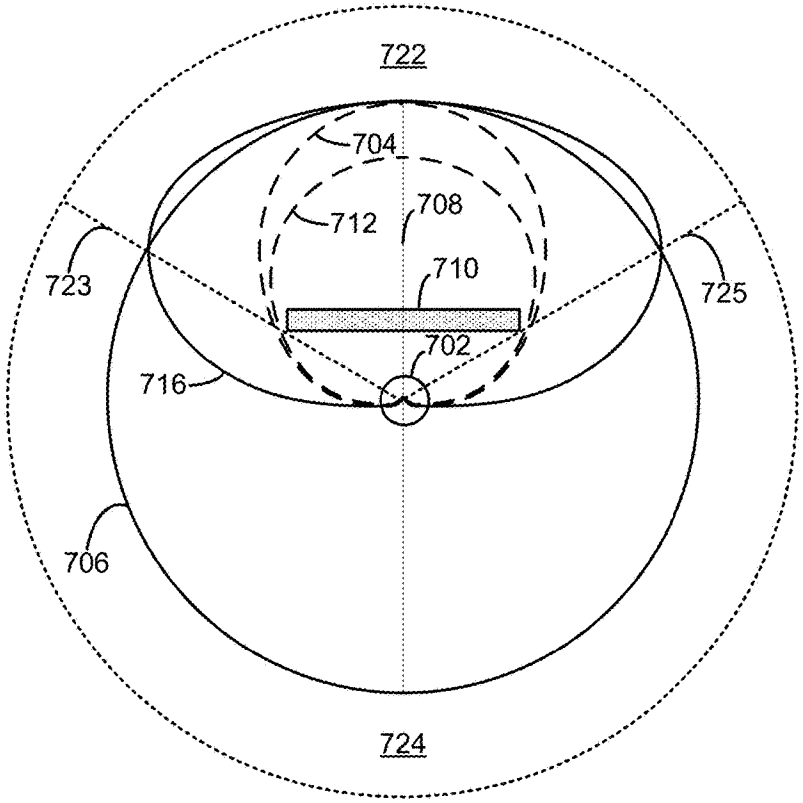
FIG. 7D shows an example acoustic filter and additional example radiation patterns of an audio driver.

FIG. 7D shows yet further example radiation patterns of the audio driver 702. Here, the playback device may amplify the portion of the signal corresponding to the first frequency even more when compared to the example depicted in FIG. 7C. This increased amplification may result in the effective radiation pattern 716 for sound waves of the first frequency generated by the audio driver 702. The effective radiation pattern 716 may be substantially equal in magnitude to the second radiation pattern 706 over the first range of directions 722. In FIG. 7D, the effective radiation pattern 716 is shown as being about equal in magnitude to the second radiation pattern 706 over a portion of the first range of directions 722 near the axis 708. At directions between the axis 708 and respective boundaries 723 and 725, a difference in magnitude between the effective radiation pattern 716 and the second radiation pattern 706 becomes more pronounced, but may still be considered non-substantial. Near the respective boundaries 723 and 725 that separate the first range of directions 722 from the second range of directions 724, the magnitudes of the second radiation pattern 706 and the effective radiation pattern 716 are about equal.

Figure 6:
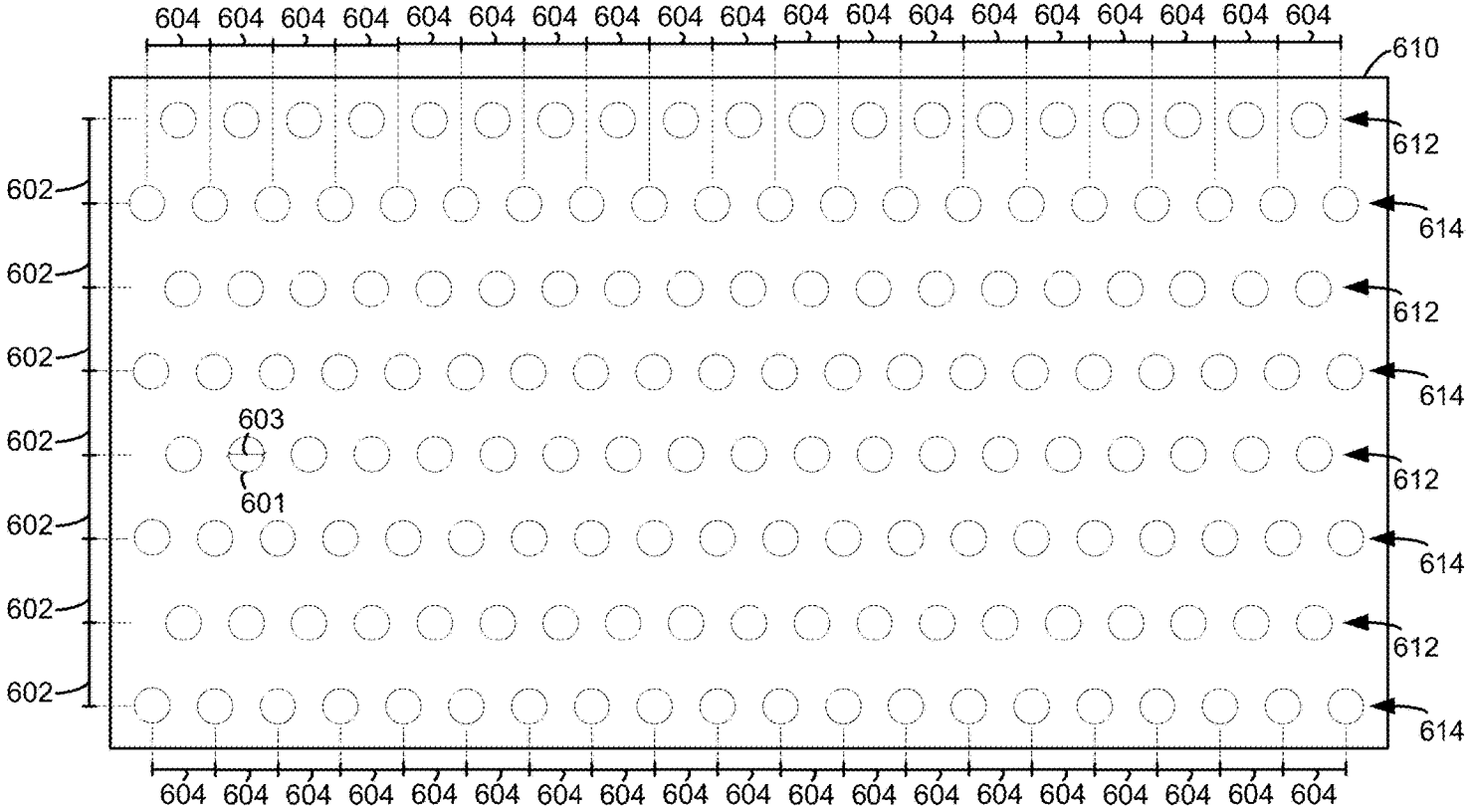
FIG. 6 shows an example acoustic filter.

FIG. 6 shows an example acoustic filter 610. The acoustic filter 610 may be similar to the acoustic filter 510 depicted in FIG. 5 or the acoustic filter 710 depicted in FIGS. 7B-D, for example. The acoustic filter 610 includes holes that are perhaps spaced according to a pattern. In other examples, the holes may be spaced randomly.

The acoustic filter 610 may include several rows of holes 612 and several rows of holes 614. Although FIG. 6 depicts four rows of holes 612 and four rows of holes 614, the acoustic filter 610 may include more or less rows of holes. The rows 612 and 614 may be separated by respective distances 602 along a first axis. The holes of the rows 612 and 614 may be separated by respective distances 604 along a second axis. In other examples, the holes may be spaced randomly, irregularly, or with varying patterns.

In some examples, the distance 602 may be about 0.7 mm or any distance greater than 0.55 mm and less than 0.75 mm. Similarly, the distance 604 may be about 0.61 mm or any distance greater than 0.55 mm and less than 0.75 mm. The distances 602 and 604 may take on other values as well.

The holes 601 of the acoustic filter 610 may have a diameter 603 of about 0.35 mm, or any value greater than 0.3 mm and less than 0.4 mm. Other example diameters 603 for the holes 601 are possible as well. The holes 601 need not all have the same diameter 603.

In some examples, the holes 601 may have a depth (into the page as viewed in FIG. 6) of about 2.0 mm, or any value greater than 1.8 mm and less than 2.2 mm. Other example depths for the holes 601 are possible as well. The holes 601 need not all have the same depths as the dimensions of the acoustic filter 610 may differ at various locations.

When the acoustic filter 610 is placed in front of an audio driver, one or more of the holes 601 may receive sound waves emitted by the audio driver. The holes 601 may provide frequency-dependent attenuation of the received sound waves according to the following equations:

$$H(\omega) = \sqrt{\frac{1}{\omega^4 M_{in}^2 C_{in}^2 + \omega^2 R_{in}^2 C_{in}^2 - 2\omega^2 M_{in} C_{in} + 1}} \quad [1]$$

$$R_{in} = \frac{\eta l}{\pi (2r)^4} \quad [2]$$

$$M_{in} = \rho l / (\pi r^2) \quad [3]$$

$$C_{in} = \pi r^2 l / (\gamma P_a) \quad [4]$$

where 'η' is the viscosity of ambient air (e.g., η=0.00018 dyne-second/cm$^2$), 'l' is the depth of the hole (e.g., l=2.0 mm), 'r' is the radius of the hole (e.g., r=0.175 mm), 'ρ' is the density of ambient air (e.g., p=1.225 kg/m$^3$), '65' is the adiabatic factor of ambient air (e.g., γ=1.4), and $P_a$ is ambient air pressure (e.g., $P_a$=760 Torr). H(ω) is a mathematical model of a frequency-dependent transfer function of each hole 601. The actual frequency-dependent attenuation provided by the holes 601 may vary from equation [1] somewhat due to factors that are unaccounted for by the model of equation [1]. For example, the frequency-dependent attenuation characterized by equation [1] may be primarily based on absorption of sound waves by air within the holes 601, however attenuation may occur via other mechanisms such as reflection and diffraction as well.

Figure 8A:
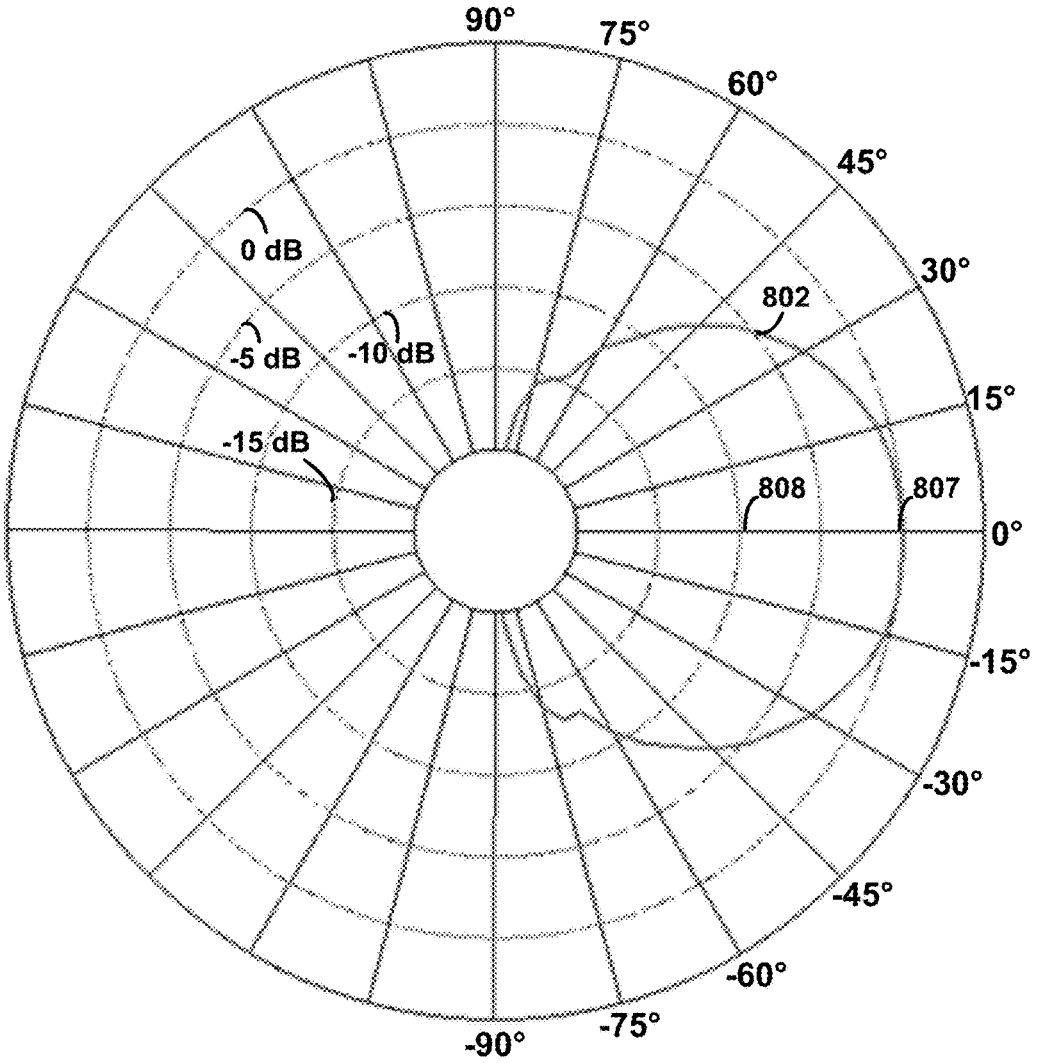
FIG. 8A shows experimental data representing a measured radiation pattern exhibited by a playback device.

FIG. 8A shows experimental data representing a measured radiation pattern 802 exhibited by a playback device. The radiation pattern 802 represents the response of the playback device at f=16 kHz. The playback device was not equipped with an acoustic filter in the example depicted in FIG. 8A. As shown in FIG. 8A, the radiation pattern 802 has a maximum magnitude of 0 dB at 807 along an axis 808 of the playback device.

Figure 8B:
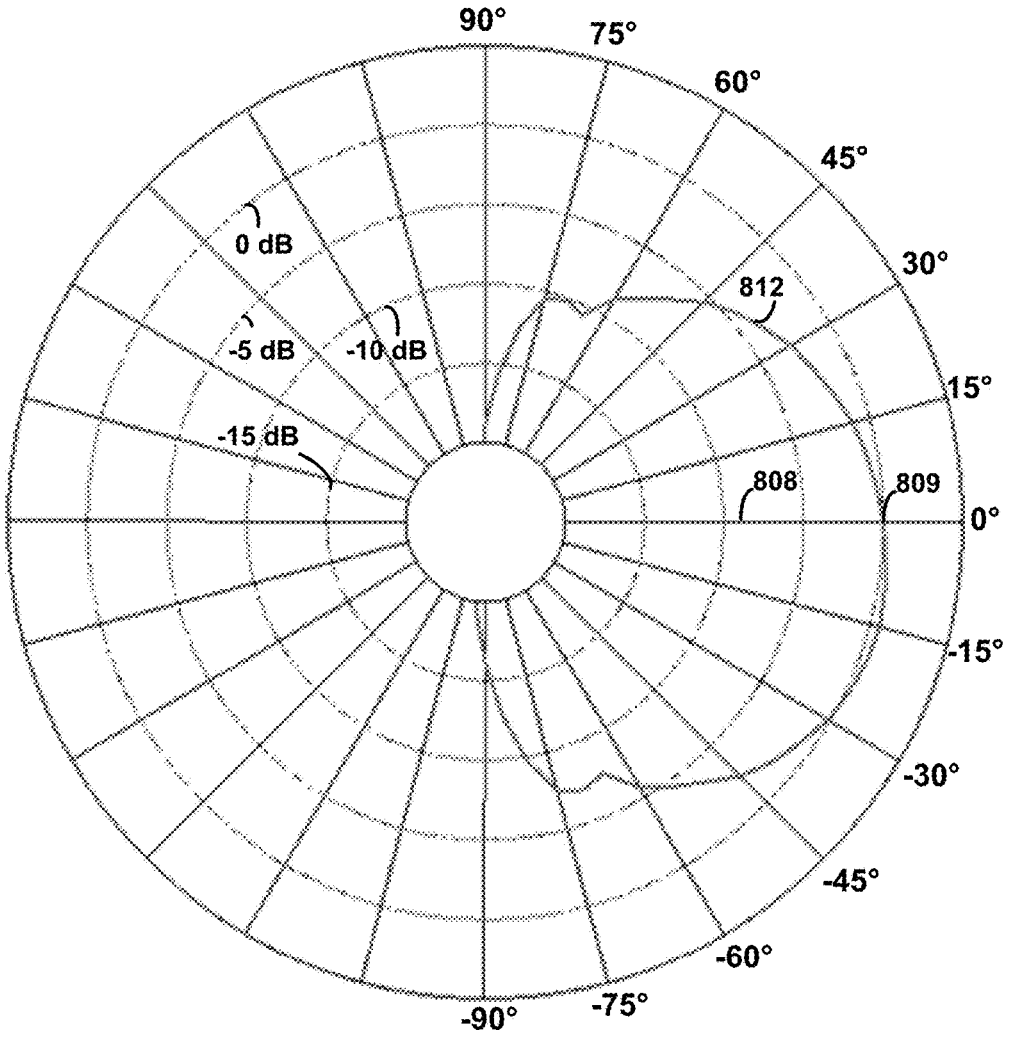
FIG. 8B shows experimental data representing a measured radiation pattern exhibited by a playback device configured with an acoustic filter.

FIG. 8B shows experimental data representing a measured radiation pattern 812 exhibited by a playback device. The radiation pattern 812 represents the response of the playback device at f=16 kHz. The playback device was equipped with an acoustic filter such as acoustic filter 510 or 710 in the example depicted in FIG. 8B. As shown in FIG. 8B, the radiation pattern 812 has a maximum magnitude at 809 along the axis 808 of the playback device. The radiation pattern 802 depicted in FIG. 8A and the radiation pattern 812 depicted in FIG. 8B have both been normalized so that their respective maximum magnitudes are depicted as 0 dB. However, the maximum magnitude 809 of radiation pattern 812 may actually be less than the maximum magnitude 807 of radiation pattern 802, due to the attenuation of sound waves at f=16 kHz provided by the acoustic filter.

The "re-shaping" effect of the acoustic filter can be demonstrated by comparing the radiation pattern 802 of FIG. 8A with the radiation pattern 812 of FIG. 8B. As shown, the radiation pattern 812 has larger (normalized) magnitudes than the radiation pattern 802 at angles ranging from at least about 30°-90° and at least about (−)30°-(−)90°. Accounting for the normalization of the radiation patterns 802 and 812, this shows that the acoustic filter was effective in attenuating sound waves generated by the audio driver at least within the directions represented by 30°-(−30°).

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. An acoustic filter comprising:

a surface configured to be at least partially axially aligned with a transducer of a playback device; and an array of apertures in the surface, wherein the array of apertures is configured to:

receive (i) first sound waves of a first range of frequencies that radiate according to a first radiation pattern having a first shape, and (ii) second sound waves of a second range of frequencies that radiate according to a second radiation pattern, wherein at least a portion of the second range of frequencies is different than the first range of frequencies;

attenuate the first sound waves such that the attenuated first sound waves radiate according to a third radiation pattern having a shape different than the first shape; and pass the second sound waves in substantial accordance with the second radiation pattern.

2. The acoustic filter of claim 1 wherein the second radiation pattern has a shape different than the first shape.

3. The acoustic filter of claim 1 wherein the first range of frequencies has a first center frequency, wherein the second range of frequencies has a second center frequency, and wherein the first center frequency is greater than the second center frequency.

4. The acoustic filter of claim 1, wherein the first sound waves comprise sound waves generated by the transducer that include a first set of sound waves that propagate within a first range of directions with respect to the acoustic filter, wherein the transducer is configured to generate a second set of sound waves that propagate within a second range of directions with respect to the acoustic filter that is outside the first range of directions, and wherein the array of apertures is configured to allow the second set of sound waves to pass substantially unattenuated through holes defined by the apertures.

5. The acoustic filter of claim 4, wherein when the acoustic filter is further configured to attenuate the first set of sound waves such that the third radiation pattern is substantially equal in magnitude to the second radiation pattern over a third range of directions with respect to the acoustic filter.

6. The acoustic filter of claim 5, wherein the third range of directions includes the first range of directions.

7. The acoustic filter of claim 1, wherein the first range of frequencies comprises frequencies within a range of 12-16 kilohertz (kHz) and the second range of frequencies comprises frequencies within a range of 6-10 kHz.

8. The acoustic filter of claim 1, wherein holes defined by the apertures are sized to absorb the first sound waves of one or more frequencies in the first range of frequencies.

9. The acoustic filter of claim 1, wherein the array of apertures includes a first aperture and a second aperture defining a first hole and a second hole, respectively, and wherein a center of the first hole is separated by a center of the second hole by a distance greater than or equal to 0.55 millimeter (mm) and less than or equal to 0.75 mm.

10. The acoustic filter of claim 1, wherein the surface has a thickness that is greater than or equal than 1.8 mm and less than or equal to 2.2 mm.

11. A playback device comprising:

a transducer configured to generate (i) first sound waves comprising a first range of frequencies that radiate according to a first radiation pattern having a first shape and (ii) second sound waves comprising a second range of frequencies that radiate according to a second radiation pattern; and an acoustic filter axially aligned with at least a portion of the transducer, wherein the acoustic filter comprises an array of apertures, and wherein the acoustic filter is configured to:

attenuate the first sound waves such that the attenuated first sound waves radiate according to a third radiation pattern having a shape different than the first shape; and pass the second sound waves in substantial accordance with the second radiation pattern.

12. The acoustic filter of claim 11 wherein the second radiation pattern has a different shape than the first radiation pattern.

13. The acoustic filter of claim 11 wherein the first range of frequencies has a first center frequency, wherein the second range of frequencies has a second center frequency, and wherein the first center frequency is greater than the second center frequency.

14. The playback device of claim 11, wherein the first sound waves include a first set of first sound waves that propagate within a first range of directions with respect to the transducer, wherein the transducer is further configured to generate a second set of first sound waves that propagate within a second range of directions with respect to the transducer, the second range of directions being different from the first range of directions, and wherein the acoustic filter is configured to allow the second set of first sound waves to pass substantially unattenuated through the apertures.

15. The playback device of claim 14, wherein the acoustic filter is further configured to attenuate the first set of first sound waves such that the third radiation pattern is substantially equal in magnitude to the second radiation pattern over a third range of directions with respect to the transducer.

16. The playback device of claim 15, wherein the third range of directions includes the first range of directions.

17. The playback device of claim 11, wherein the first range of frequencies includes one or more frequencies within a range of 12-16 kilohertz (kHz), and wherein the second range of frequencies includes one or more frequencies within a range of 6-10 kHz.

18. The playback device of claim 11, wherein the array of apertures includes a first aperture and a second aperture defining a first hole and a second hole, respectively, and wherein a center of the first hole is separated by a center of the second hole by a distance greater than or equal to 0.55 mm and less than or equal to 0.75 mm.

19. The playback device of claim 11, wherein at least one of the apertures has a diameter that is greater than 0.3 mm and less than 0.4 mm.

20. A playback device comprising:

a transducer configured to generate (i) first sound waves comprising a first range of frequencies that radiate according to a first radiation pattern having a first shape and (ii) second sound waves comprising a second range of frequencies that radiate according to a second radiation pattern; and an acoustic filter axially aligned with at least a portion of the transducer, wherein the acoustic filter comprises an array of apertures, and wherein the acoustic filter is configured to:

reshape the first radiation pattern such that the first sound waves radiate according to a third radiation pattern having a shape different than the first shape; and pass the second sound waves in substantial accordance with the second radiation pattern.

* * * * *